US011781424B2

(12) United States Patent
Merry

(10) Patent No.: US 11,781,424 B2
(45) Date of Patent: Oct. 10, 2023

(54) REGISTERING FIBER POSITION TO WELL DEPTH IN A WELLBORE

(71) Applicant: Saudi Arabian Oil Company, Dhahran (SA)

(72) Inventor: Harold W K Merry, Houston, TX (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/551,913

(22) Filed: Dec. 15, 2021

(65) Prior Publication Data

US 2023/0184094 A1 Jun. 15, 2023

(51) Int. Cl.

| | |
|---|---|
| ***E21B 47/095*** | (2012.01) |
| ***E21B 47/135*** | (2012.01) |
| ***E21B 47/14*** | (2006.01) |
| ***E21B 47/107*** | (2012.01) |
| ***E21B 47/04*** | (2012.01) |

(52) U.S. Cl.

CPC ..... *E21B 47/095* (2020.05); *E21B 47/04* (2013.01); *E21B 47/107* (2020.05); *E21B 47/135* (2020.05); *E21B 47/14* (2013.01)

(58) Field of Classification Search

CPC ..... E21B 47/04; E21B 47/09; E21B 47/095; E21B 47/135; E21B 47/14; G01B 11/02; G02F 1/11

See application file for complete search history.

(56) References Cited

U.S. PATENT DOCUMENTS

| | | | | |
|---|---|---|---|---|
| 6,896,056 | B2 | 5/2005 | Mendez et al. | |
| 7,900,699 | B2 | 3/2011 | Ramos et al. | |
| 8,989,527 | B2 * | 3/2015 | Joinson | G02B 6/00 385/12 |
| 9,127,531 | B2 | 9/2015 | Maida et al. | |
| 10,120,104 | B2 * | 11/2018 | Roy | G01V 1/46 |
| 10,935,417 | B2 * | 3/2021 | Cedilnik | G01D 5/35361 |
| 10,947,828 | B2 * | 3/2021 | Roy | E21B 47/135 |
| 11,414,982 | B2 * | 8/2022 | Granville | E21B 47/06 |
| 11,473,421 | B2 * | 10/2022 | Cooper | G01V 1/226 |
| 2012/0092960 | A1 * | 4/2012 | Gaston | E21B 47/14 367/35 |

(Continued)

*Primary Examiner* — Jennifer H Gay
(74) *Attorney, Agent, or Firm* — Fish & Richardson P.C.

(57) ABSTRACT

A downhole tool system includes a downhole tool that includes a tool body configured to move within a wellbore, a depth detection sub-assembly and configured to generate a signal based on a known depth location of the tool body in the wellbore, an acoustic transmitter sub-assembly including an acoustic pinger configured to generate acoustic pulses, and a measurement and control sub-assembly configured to receive the signal from the depth detection sub-assembly and, based on the signal, activate the acoustic transmitter sub-assembly to initiate the acoustic pulses from the acoustic pinger. The system further includes a control system that includes a fiber optic interrogator communicably coupled to a fiber strand installed in the wellbore and configured to determine a travel time of the tool body along the fiber strand or a particular distributed acoustic sensing (DAS) channel of a plurality of DAS channels based on a detection of at least one disturbance in the fiber strand caused by the acoustic pulses.

26 Claims, 7 Drawing Sheets

(56) References Cited

U.S. PATENT DOCUMENTS

| | | | | |
|---|---|---|---|---|
| 2012/0111104 | A1* | 5/2012 | Taverner | G01H 9/004 73/152.16 |
| 2012/0308174 | A1 | 12/2012 | Head | |
| 2013/0249705 | A1 | 9/2013 | Sharp et al. | |
| 2013/0279841 | A1* | 10/2013 | Joinson | G01B 7/02 385/12 |
| 2016/0363694 | A1* | 12/2016 | Roy | E21B 47/135 |
| 2016/0369607 | A1* | 12/2016 | Roy | E21B 43/305 |
| 2017/0342823 | A1* | 11/2017 | Shah | E21B 33/12 |
| 2018/0328120 | A1* | 11/2018 | Therrien | E21B 17/1035 |
| 2019/0128731 | A1* | 5/2019 | Cedilnik | G01D 5/35361 |
| 2020/0199999 | A1* | 6/2020 | Cooper | E21B 47/113 |
| 2020/0333487 | A1* | 10/2020 | Padhi | G01V 1/42 |
| 2021/0032979 | A1* | 2/2021 | Granville | G01V 11/002 |
| 2022/0333468 | A1* | 10/2022 | Bland | E21B 43/2607 |
| 2022/0412821 | A1* | 12/2022 | Jaaskelainen | G01K 11/324 |

* cited by examiner

REGISTERING FIBER POSITION TO WELL DEPTH IN A WELLBORE

TECHNICAL FIELD

The present disclosure describes apparatus, systems, and methods for associating well depths with measurements obtained by fiber optic sensing techniques.

BACKGROUND

One important consideration of a subsurface oil or gas well is knowledge of an exact depth (or depths) from which a hydrocarbon reservoir is producing or being injected into. Conventionally, detailed geophysical measurements are logged with well depth over a length of the well. Well depth can also be known by detecting casing collars with a casing collar locator (CCL) log. Most wells are lined by casing pipe which isolates the well from the rock formations around it and prevents it from falling in. The casing is made up of pipe joints of roughly 40 foot length joined together by pipe collars. The length of each casing pipe joint is carefully measured, so that the depth of the collars between joints is accurately known. A casing collar log references log measurements to a well casing to subsequently identify exact depth. In some aspects, fiber optic sensing can be used to help identify specific petrophysical properties along the entire wellbore. However, inaccuracies of fiber length, for example, related to the manufacture of the fiber cable or tubes that provide protection for conveyance into the well, can cause inaccuracies tying fiber length or interval to well depth.

SUMMARY

In an example implementation, a downhole tool system includes a downhole tool that includes a tool body configured to move within a wellbore between a terranean surface and a subterranean formation, a depth detection sub-assembly positioned within the tool body and configured to generate a signal based on at least one known depth location of the tool body in the wellbore, an acoustic transmitter sub-assembly positioned within the tool body and including an acoustic pinger configured to generate one or more acoustic pulses, and a measurement and control sub-assembly positioned within the tool body and configured to receive the signal from the depth detection sub-assembly and, based on the signal, activate the acoustic transmitter sub-assembly to initiate the one or more acoustic pulses from the acoustic pinger. The system further includes a control system that includes a fiber optic interrogator communicably coupled to a fiber strand installed in the wellbore and configured to determine a travel time of the tool body along the fiber strand or a particular distributed acoustic sensing (DAS) channel of a plurality of DAS channels based at least in part on a detection of at least one disturbance in the fiber strand caused by the one or more acoustic pulses.

In an aspect combinable with the example implementation, the depth detection sub-assembly includes a casing collar locator (CCL) configured to detect at least one casing collar of a plurality of casing collars installed within a tubular string in the wellbore and generate the signal based on the detection of the at least one casing collar In another aspect combinable with any of the previous aspects, the control system is configured to determine a length of the portion of the fiber strand based at least in part on a determination of the particular distributed acoustic sensing (DAS) on which the at least one disturbance in the fiber strand caused by the one or more acoustic pulses is detected.

In another aspect combinable with any of the previous aspects, the control system is configured to determine the length of the portion of the fiber strand by multiplying the particular DAS channel by a channel interval.

In another aspect combinable with any of the previous aspects, the control system is configured to determine a length of the fiber strand by multiplying a downhole most DAS channel by a channel interval.

In another aspect combinable with any of the previous aspects, the control system is configured to determine a wellbore depth of the wellbore based at least in part on the determined length of the fiber strand.

In another aspect combinable with any of the previous aspects, the control system is configured to associate and register fiber length or interval to a depth of a particular casing collar in the wellbore.

In another aspect combinable with any of the previous aspects, the length of the portion of the fiber strand includes a distance of the portion of the fiber strand between a known location and a location of the detected at least one casing collar.

In another aspect combinable with any of the previous aspects, the tool body includes a top end bell configured to connect to the downhole conveyance that includes a wireline, a slickline, a coiled tubing, or a tubular workstring.

In another aspect combinable with any of the previous aspects, the tool body is configured to move in an uphole direction or a downhole direction by a downhole conveyance.

In another aspect combinable with any of the previous aspects, the tool body includes an untethered tool body, and the downhole conveyance includes at least one of a fluid in the wellbore or a weight of the tool body.

In another aspect combinable with any of the previous aspects, the untethered tool body is configured to move in an uphole direction or a downhole direction based at least in part on a circulation of the fluid in the wellbore.

In another aspect combinable with any of the previous aspects, the tool body includes a hermetically sealed housing that encloses the depth detection sub-assembly, the acoustic transmitter sub-assembly, and the measurement and control sub-assembly.

In another example implementation, a method includes moving a downhole tool in a wellbore between a terranean surface and a subterranean formation. The downhole tool includes a tool body, a depth detection sub-assembly positioned within the tool body, an acoustic transmitter sub-assembly positioned within the tool body and including an acoustic pinger, and a measurement and control sub-assembly positioned within the tool body and communicably coupled to the depth detection sub-assembly and the acoustic transmitter sub-assembly. The method further includes determining, during the movement of the downhole tool, at least one known depth location of the tool body in the wellbore; generating a signal with the depth detection sub-assembly based on the determined at least one known depth location of the tool body in the wellbore; activating, with the measurement and control sub-assembly and based on the generated signal, the acoustic transmitter sub-assembly to initiate one or more acoustic pulses from an acoustic pinger of the acoustic transmitter sub-assembly; detecting, with a control system that includes a fiber optic interrogator communicably coupled to a fiber strand installed in the wellbore, at least one disturbance in the fiber strand caused by the one or more acoustic pulses; and determining, with the control system, a travel time of the tool body along the fiber strand or a particular distributed acoustic sensing (DAS) channel of a plurality of DAS channels based at least in part on a detection of at least one disturbance in the fiber strand caused by the one or more acoustic pulses.

In an aspect combinable with the example implementation, the depth detection sub-assembly includes a casing collar locator and the method further includes detecting, during the movement of the downhole tool, at least one casing collar of a plurality of casing collars installed within a tubular string in the wellbore with the casing collar locator; and generating the signal with the casing collar locator based on the detection of the at least one casing collar.

Another aspect combinable with any of the previous aspects further includes determining, with the control system, the length of the portion of the fiber strand based at least in part on a determination of the particular DAS channel on which the at least one disturbance in the fiber strand caused by the one or more acoustic pulses is detected.

Another aspect combinable with any of the previous aspects further includes determining, with the control system, the length of the portion of the fiber strand by multiplying the particular DAS channel by a channel interval.

Another aspect combinable with any of the previous aspects further includes determining, with the control system, determine a length of the fiber strand by multiplying a downhole most DAS channel by a channel interval.

Another aspect combinable with any of the previous aspects further includes determining, with the control system, a wellbore depth of the wellbore based at least in part on the determined length of the fiber strand.

Another aspect combinable with any of the previous aspects further includes associating and registering fiber length or interval to a depth of a particular casing collar in the wellbore.

In another aspect combinable with any of the previous aspects, the length of the portion of the fiber strand includes a distance of the portion of the fiber strand between a known location and a location of the detected at least one casing collar.

Another aspect combinable with any of the previous aspects further includes moving the downhole tool in the wellbore on or with a downhole conveyance that includes a wireline, a slickline, a coiled tubing, or a tubular workstring, and is connected to a top end bell of the tool body.

In another aspect combinable with any of the previous aspects, moving the tool body includes moving the tool body in an uphole direction or a downhole direction while coupled to the downhole conveyance.

In another aspect combinable with any of the previous aspects, the tool body includes an untethered tool body, the method further including moving the untethered tool body with a fluid in the wellbore.

In another aspect combinable with any of the previous aspects, moving the untethered tool body with the fluid in the wellbore includes moving the untethered tool body in an uphole direction or a downhole direction based at least in part on a circulation of the fluid in the wellbore.

Another aspect combinable with any of the previous aspects further includes hermetically sealing the tool body against one or more wellbore fluids in the wellbore.

Implementations of downhole tool systems for determining wellbore depth according to the present disclosure may include one or more of the following features. For example, downhole tool systems according to the present disclosure can eliminate or reduce ambiguity between fiber length and well depth. As another example, downhole tool systems according to the present disclosure can enable a fiber to be used as a permanent "ground□truthing" sensing monitor over an entire wellbore for depth determination.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1A:
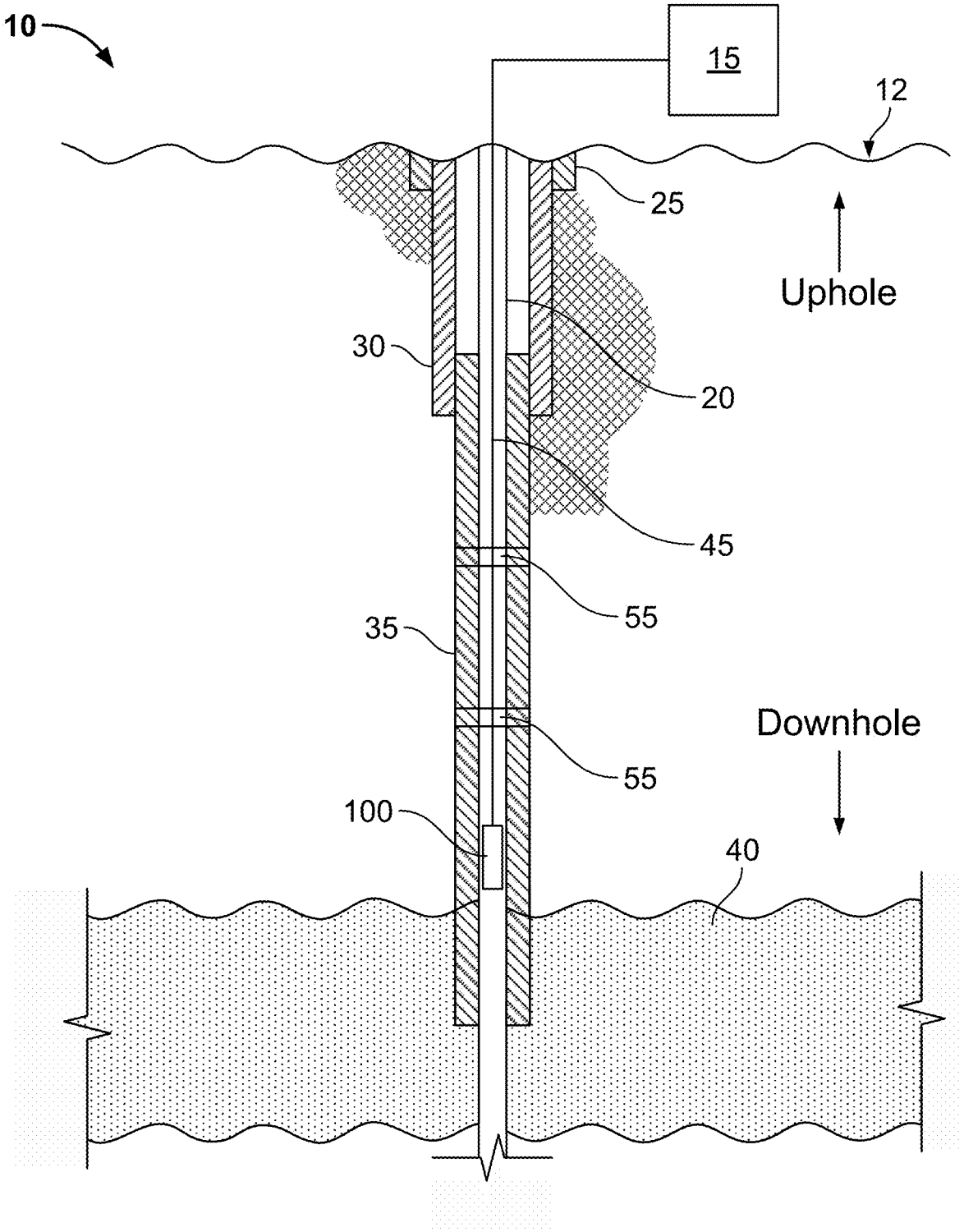
FIG. 1A is a schematic diagram of a wellbore system that includes an example implementation of a downhole tool for determining a wellbore depth according to the present disclosure.

FIG. 1A is a schematic diagram of wellbore system 10 that includes a downhole tool 100 according to the present disclosure. Generally, FIG. 1A illustrates a portion of one embodiment of a wellbore system 10 according to the present disclosure in which the downhole tool 100 can be run into a wellbore 20 and activated during the run in (or run out) process through a wellbore tubular within the wellbore 20. In this example, the downhole tool 100 is connected to a downhole conveyance 45 during a run in and run out operation in the wellbore 20. The downhole conveyance 45 can be, for example, a tubing (tubing work string or coiled tubing), wireline, slickline, or other conductor.

In alternative aspects, the downhole tool 100 can be untethered in that, during the running in process, the running out process, or during any operations of the downhole tool 100 in the wellbore 20, the downhole tool 100 is disconnected, decoupled, or otherwise unattached from a downhole conveyance. In some aspects, the untethered downhole tool 100 may be conveyed into the wellbore 20, or out of the wellbore 20 by, for instance, a fluid circulated within the wellbore 20, either alone or in combination with other forces on the untethered downhole tool 100 (for example, gravitational forces, buoyant forces, hydrodynamic forces, or a combination thereof). In some aspects, the untethered downhole tool 100 comprises a relatively lightweight miniaturized tool (for example, a tool with a size several times smaller than the wellbore diameter).

According to the present disclosure, the downhole tool 100 can be run into the wellbore 20 in order to register or associate a length or interval of a fiber optic cable installed in the wellbore to casing collars that are installed along the wellbore from a terranean surface to a particular depth, such as at or near a subterranean hydrocarbon reservoir. For example, as shown, the wellbore can be or include a production casing 35 that extends into a subterranean formation 40 and includes casing collars 55 that connect joints of the production casing 35 together (for example, threading), in order to construct the casing 35.

For example, when a fiber optic cable (such as fiber 57) is installed behind casing in a wellbore such as wellbore 20, determining an exact reservoir or well depth that corresponds to each length along the fiber can be advantageous. However, inaccuracies of fiber strand length can be related to the manufacture of the fiber cable or tubes that provide rugosity and strengthening for conveyance in the wellbore. Further, an overstuffing factor (of the strand into the cable or tube) may range from 0.5% to 3% of fiber, which can result in differences between fiber strand length and a length of a cable or tube into which the fiber is installed can result in fiber length-to-well depth inaccuracies. For example, for a 10,000 ft. long fiber cable (into which a fiber strand is this difference may range from 50 ft. (for 0.5% overstuffing) to 300 ft. (for 3% overstuffing).

The downhole tool 100, however, addresses this problem (and others) by registering a well depth to the fiber length or interval along the production casing 35 (or other casing or tubing) and tying the casing collar locations to the wellbore depth and fiber length or interval.

Figure 1B:
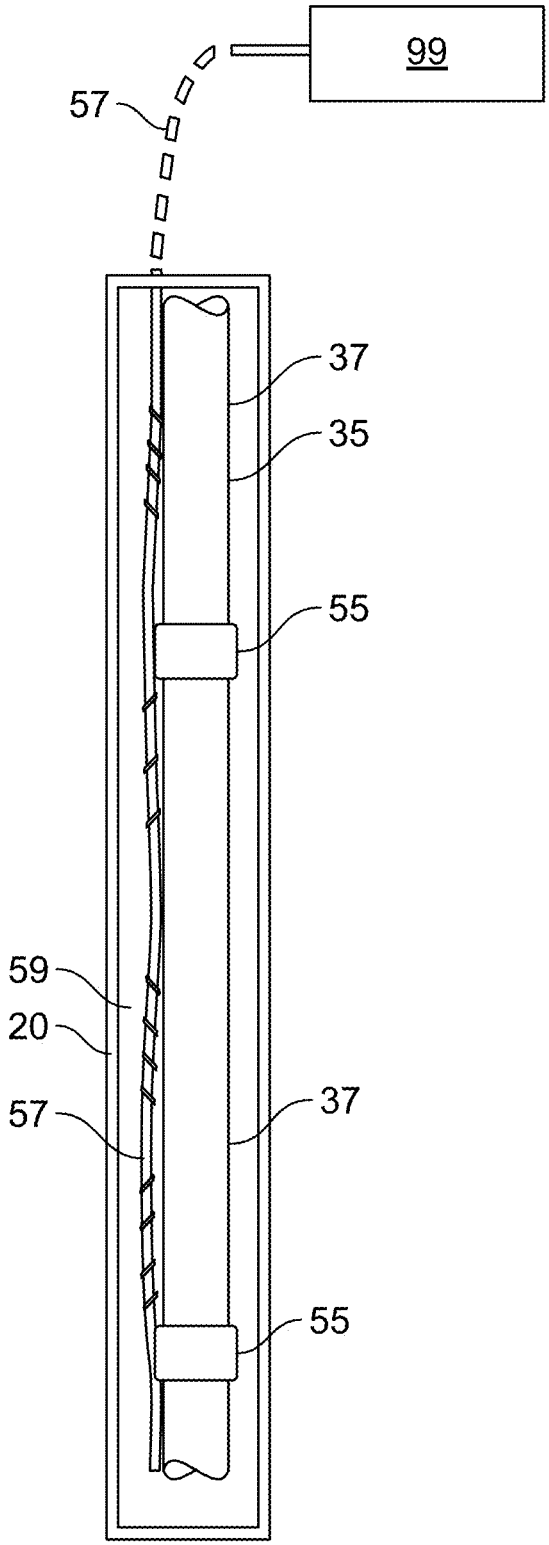
FIG. 1B is a schematic diagram of a portion of the wellbore system of FIG. 1A.

Turning briefly to FIG. 1B, a portion of the wellbore system 10 is shown, including the production casing 35. As shown in this figure, joints 37 of the production casing 35 are joined by casing collars 55, thereby constructing the production casing 35 in the wellbore 20. A fiber optic cable ("fiber") 57 is installed down a length of the production casing 35 and in between the production casing 35 and a geologic formation that comprises the subterranean reservoir (in other words, subterranean formation 40 or one or more other formations). In some aspects, as shown in this figure, a cement layer 59 is also installed between the production casing 35 and the formation in order to secure the production casing 35 within the wellbore 20. While the fiber 57 is shown installed between the production casing 35 and the formation in this example, in the case of multiple, overlapping tubing strings installed in the wellbore 20, the fiber 57 can be installed between the overlapping tubular strings, such as between the production casing 35 and other wellbore tubular. In some aspects, the fiber 57 can include a fiber strand encased in a cable or tube; alternatively, the fiber 57 can be a bare fiber strand that extends into the wellbore 20 as shown.

The fiber 57 is connected, for example, at the terranean surface 12 to a fiber optic interrogator 99. In some aspects, the fiber optic interrogator 99 can comprise a part of a control system 15 (shown in FIG. 1A) for the wellbore system 10 that is operable to perform one, some, or all of any computer-implemented operations according to the present disclosure. In some aspects, the fiber optic interrogator 99 is operable to transmit high frequency light pulses down the fiber 57 (in other words, from the terranean surface downhole) and record light reflected from anomalies in the fiber 57. Such anomalies can be caused by one or more disturbances at any point along the fiber 57, which cause the anomalies to shift position and are recorded by the fiber optic interrogator 99.

As shown, the wellbore system 10 accesses the subterranean formation 40 and provides access to hydrocarbons located in such subterranean formation 40. In an example implementation of system 10, the system 10 may be used for a production operation in which the hydrocarbons may be produced from the subterranean formation 40 within a wellbore tubular (for example, through the production casing 35 or other production tubular).

A drilling assembly (not shown) may be used to form the wellbore 20 extending from the terranean surface 12 and through one or more geological formations in the Earth. One or more subterranean formations, such as subterranean formation 40, are located under the terranean surface 12. As will be explained in more detail below, one or more wellbore casings, such as a surface casing 30 and production casing 35, may be installed in at least a portion of the wellbore 20. In some embodiments, a drilling assembly used to form the wellbore 20 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the production casing 35. Any of the illustrated casings, as well as other casings or tubulars that may be present in the wellbore system 10, may include one or more casing collars 55 (as shown in FIGS. 1A-1B). In the example implementation of wellbore system 10, the production casing 35 and casing collars 55 (as well as other tubular casings) can be made of steel.

In some aspects, wellbore 20 can be filled with a fluid, such as a drilling fluid or otherwise. In such aspects, the downhole tool 100, as an untethered tool, may be oriented and weighted to move downhole from the terranean surface 12 and toward the subterranean formation 40 through the wellbore fluid. In some aspects, the wellbore fluid is not static in the wellbore 20 but is a circulated (for example, pumped) wellbore fluid 50 that dynamically moves an untethered version of the downhole tool 100 through the wellbore 20. Thus, in some aspects, the untethered version of the downhole tool 100 is moved through the wellbore 20 in a fluid (either static or dynamic) without being connected to any other form of downhole conveyance, such as a working string or downhole conductor (for example, wireline or slickline or other conductor).

The illustrated control system 15 can be located at the terranean surface 12 or can also be integral with the downhole tool 100. In some aspects, the control system 15 can represent a micro-processors based control system that includes one or more hardware processors, one or more memory modules (for example, non-transitory computer readable media), and instructions stored on the one or more memory modules that can be executed by the one or more hardware processors to perform operations.

Figure 2:
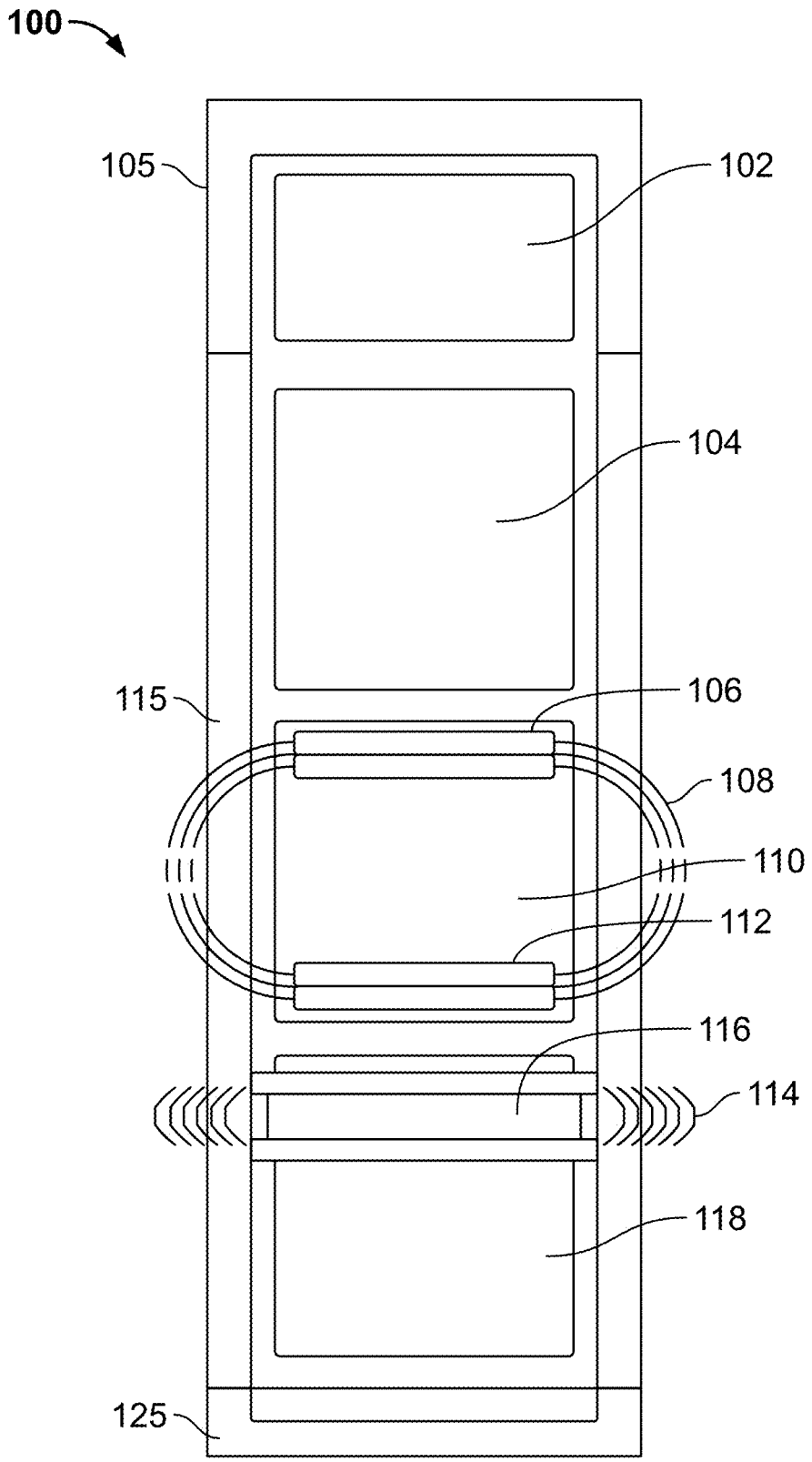
FIG. 2 illustrates a schematic illustration of an example implementation of a downhole tool for determining a wellbore depth according to the present disclosure.

FIG. 2 illustrates a schematic illustration of an example implementation of the downhole tool 100. In this example implementation, the downhole tool 100 includes five components, several of which can be placed within the tool 100 at various locations. As shown in FIG. 2, the downhole tool 100 includes a tool body 115 that houses one or more components. The tool body 115 includes or is connected to a top (uphole) end bell 105 and a bottom (downhole) end bell 125. In some aspects, each of the top end bell 105 and the bottom end bell 125 can be configured to connect (for example, threading or otherwise) with another downhole tool, a downhole conveyance, or other portion of a downhole tool string. The tool body 115, in some aspects, comprises a hermetically sealed housing built to withstand a high pressure, high temperature, corrosive downhole environment and be capable of handling downhole deployment in the wellbore 20.

For example, in some aspects, the top end bell 105 can be configured to connect to the downhole conveyance 45 through a conveyance interface 102 as shown (e.g., threads, or a wireline or slickline connection). In some aspects, the conveyance interface 102 comprises an electro□mechanical module that enables connection to multiple conveyance schemes such as wireline, slickline, coiled tubing, production tubing and tether□less systems.

In some aspects, downhole tool 100 can be used in subsurface wells that are used in the process of producing oil and gas from subsurface reservoirs. These include producing wells that bring the hydrocarbons from the reservoir to the surface, monitoring wells that provide subsurface access for measurement tools, injection wells that are used to inject other fluids into the reservoir to help to mobilize the hydrocarbons, water producing wells which may be used to produce water which is then injected into a hydrocarbon reservoir, and wells that are drilled for the purpose of making geophysical measurements.

In each kind of well, measurements of downhole properties can be made by the downhole tool 100 are made to help identify the location of hydrocarbons or optimize or detect problems in the overall process of producing hydrocarbons from subsurface reservoirs. Downhole properties can include temperatures, pressures, seismic signals naturally generated by fracturing of rock in response to downhole stresses, seismic signals generated by man-made sources on the surface in the process of exploration for hydrocarbons, electrical fields or magnetic fields generated by man-made sources in the exploration for hydrocarbons, chemical properties of downhole fluids, flow rates and compositions of downhole flows, including flow along the wellbore and flow from the reservoir into the wellbore.

In some conventional techniques, optical fiber can be used to measure these properties, where the characteristics of the backscattered light from the fiber are used to determine the properties. In distributed temperature sensing (DTS) the wavelength shift of the anti-stokes Raman scattered light is related to temperature. In distributed acoustic sensing (DAS) the stretching or compressing of the backscattered light pattern is related to the strain (i.e., the stretching or compressing) of the fiber.

In other conventional techniques, other downhole properties can also be measured by placing a transduction system in proximity to the fiber whereby the property of interest is converted into a property that affects the characteristics of the backscattered light from the fiber, such as by using a piezoelectric material to convert an electrical field to a mechanical strain which in turn strains the fiber. The conventional techniques have in common that they provide a measurement as a function of optical travel time which is the time it takes the light to travel from the laser source (typically at the surface of the earth) to the point of scattering and back to the light detector (typically near the source at the surface). To apply these measurements of downhole properties to exploration and production of hydrocarbons, it is necessary to know where the measurement took place. Thus, the optical travel time along the fiber needs to be related to the depth (which conventionally means distance along the wellbore even if the wellbore is not vertical). Relating optical travel time to depth is complicated by the fact that the speed of light propagation along a fiber may vary slightly between fibers, the fiber may not be completely straight along the wellbore, and there may be an unknown length of fiber between the laser source and detector and the zero-depth point of the well. Example implementations of the downhole tool 100, however, overcome these problems with conventional techniques by accurately relating optical travel time along a fiber to depth along the wellbore so that the measurements obtained with the fiber can be registered to depth.

In this example implementation, the downhole tool 100 includes a measurement and control sub-assembly 104 within the tool body 115. In some aspects, the measurement and control sub-assembly 104 is communicably coupled to other components of the tool 100, such as a depth detection sub-assembly 110 and an acoustic transmitter sub-assembly 118. For example, in some aspects, the measurement and control sub-assembly 104 is configured to receive sensed measurements or signals from one or more components of the downhole tool 100 (for example, the depth detection sub-assembly 110), as well as activate one or more components of the downhole tool 100 (for example, the depth detection sub-assembly 110, the acoustic transmitter sub-assembly 118, or both). In some aspects, the measurement and control sub-assembly 104 can also store (at least transiently) such measurements or signals and transmit the stored data, for example, to control system 15 through the downhole conveyance 45.

In the illustrated example of the downhole tool 100, the depth detection sub-assembly 100 comprises a casing collar locator ("CCL") 110. The CCL 110 uses electromagnetic flux to sense a casing collar (such as casing collars 55) as the downhole tool 100 passes thereby. For example, the CCL 110 includes electromagnets 106 and 112 that are arranged around a central coil (as part of the CCL 110). When the CCL 110 passes by a steel casing collar, magnetic lines of flux ("magnetic flux") 108 are distorted, which can create a change in a magnetic field around the conducting coil, within which current is induced. The change in magnetic field can then be sensed (subsequent to amplification in some aspects) and stored or recorded by the measurement and control sub-assembly 104. In some aspects, the change in magnetic field can be in the form of a voltage spike in the conducting coil of the CCL 110. Thus, as the CCL 110 passes by a casing collar 55 (and, for instance, each casing collar 55 in the production casing 35), the distinct signal (for example, the voltage spike) at a precise connection point of the casing collar 55 within the wellbore 20 is recorded and captured by the measurement and control sub-assembly 104.

The depth detection sub-assembly 110 can also comprise other devices that can determine or detect a known depth of the downhole tool 100 in the wellbore. For example, the depth detection sub-assembly 110 can comprise an assembly that can measure a length of wireline cable (in the case of the tool 100 connected to a wireline downhole conveyance) spooled out at the surface and telemetering (transmitting) depth information down the cable to the depth detection sub-assembly 110 in the tool (which can generate a signal used by the tool 100 to activate a pinger). As another example, the depth detection sub-assembly 110 can comprise an assembly that can measure a length of wireline cable spooled out at the surface. A surface control system can then determine when the tool 100 is at the desired depth and telemeters a signal to the depth detection sub-assembly 100 to generate the signal used by the tool 100 to activate a pinger.

As another example, the depth detection sub-assembly 110 can comprise an assembly that can measure a length of slickline cable (in the case of the tool 100 being connected to a slickline conveyance) spooled out at the surface. With slickline, an operator at the surface can know the depth of the tool 100 as a function of time. The depth detection sub-assembly 110 can then be programmed to generate the signal for the tool 100 to ping at predetermined times (by an acoustic pinger as described herein).

As a further example, the depth detection sub-assembly 110 can comprise an assembly that can measure an amount of coiled tubing (in the case of the tool 100 being connected to a coiled tubing conveyance) spooled out into the well to push the tool 100 along the well. A signal can be transmitted down a wireline in the coiled tubing to tell the depth detection sub-assembly 110 to generate a signal for the tool 100 to ping when the tool 100 is at a desired depth. Alternatively, depth information can be transmitted down a wireline in the coiled tubing to the depth detection sub-assembly 110 so that the depth detection sub-assembly 110 can decide when it is at a desired depth to generate the signal. Alternatively, time vs. depth of the tool 100 can be recorded at the surface where the depth detection sub-assembly 110 is programmed to generate the signal at certain times (e.g., to activate an acoustic pinger associated with depth by the operator at the surface, as with slickline tools).

In some aspects, the depth detection sub-assembly 110 can be excluded from the downhole tool 100, as well as an acoustic pinger. For example, an acoustic pinger can be included in a bottom hole assembly or otherwise incorporated into the drill string. The amount of drill string is measured in the well and either a signal is sent down wired drill pipe to tell the acoustic pinger when to transmit or what its depth is, or the pinger transmits at known times. Thus, depth of a ping can be determined based on the time when the ping was emitted. However, an acoustic pinger in the drill string is less desirable than the other implementations, as it can only associate depth with fiber optic sensor measurements for fiber that is in parts of the well which are already cased. Typically the well is cased in intervals, and after casing a certain interval, the well is drilled to the next interval.

Turning back to FIG. 2, the illustrated example of the downhole tool 100 also includes the acoustic transmitter sub-assembly 118. Although shown between the depth detection sub-assembly 110 and the bottom end bell 125 in FIG. 2, the acoustic transmitter sub-assembly 118 can also be positioned in the downhole tool 100 between the depth detection sub-assembly 110 and the top end bell 105. In some aspects, the acoustic transmitter sub-assembly 118 includes an acoustic pinger 116 configured to transmit or generate an acoustic signal 114, such as when commanded to do so by the measurement and control sub-assembly 104. In some aspects, the measurement and control sub-assembly 104 commands the acoustic pinger 116 to transmit or generate the acoustic signal 114 at a specific time after a detection of the signal from the depth detection sub-assembly 110. In some aspects, the acoustic signal 114 is comprised of one or a series of high energy acoustic pulses.

In some aspects, the particular implementation of the depth detection sub-assembly 110 can depend on the type of downhole conveyance. For example, implementations that depend on measuring a length of a physical conveyance, such as a cable or conductor or workstring, would need such a physical conveyance. This could also include a casing collar locator. However, for an untethered downhole tool 100 that uses, e.g., fluid as a downhole conveyance, the depth detection sub-assembly 110 may require an implementation that does not measure a length of a physical downhole conveyance, such as a casing collar locator.

Figure 3B:
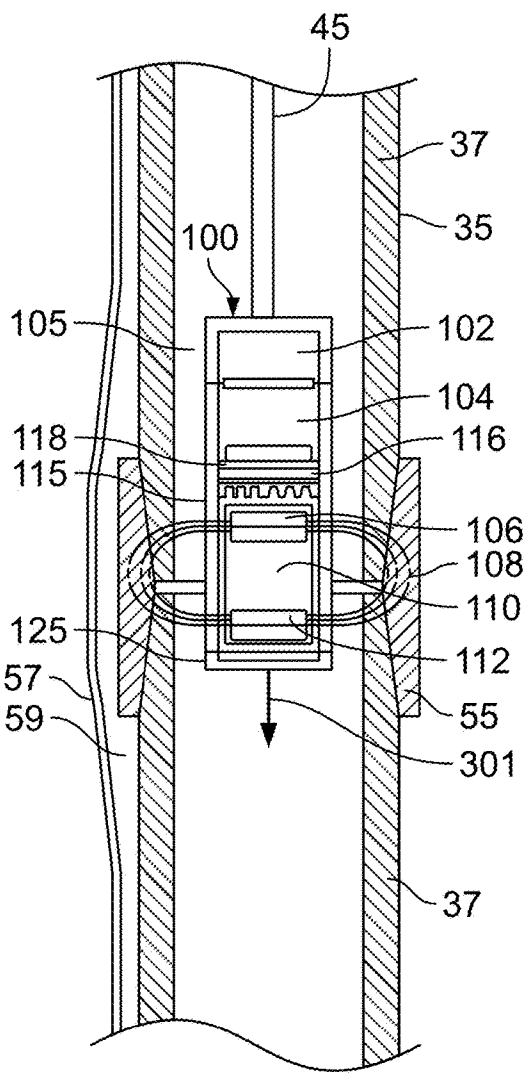
FIGS. 3A-3C are schematic illustrations of an example implementation of a downhole tool during an operation for determining a wellbore depth according to the present disclosure.
Figure 3A:
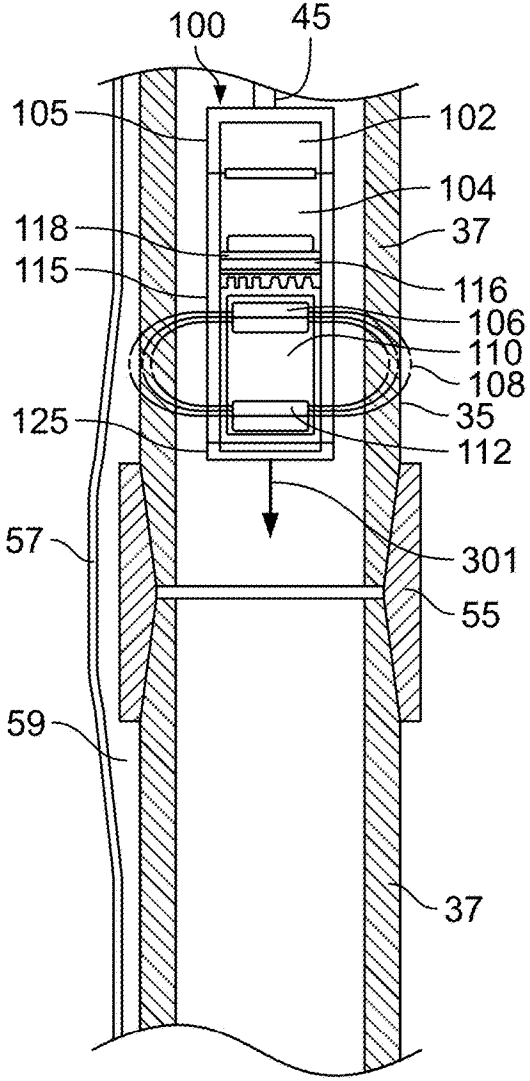
Figure 3C:
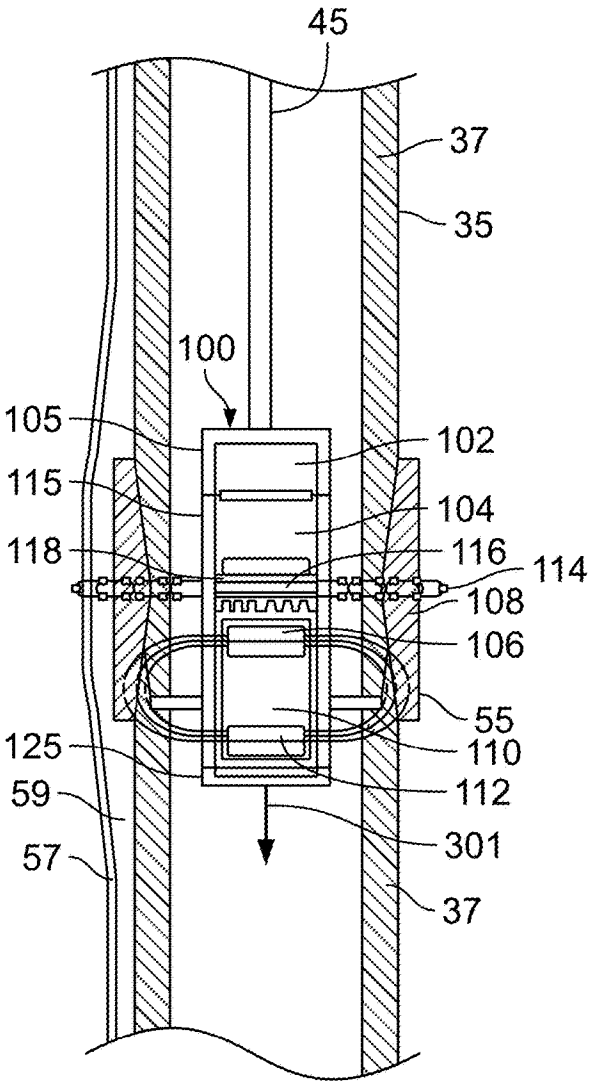

FIGS. 3A-3C are schematic illustrations of an example implementation of a downhole tool during an operation for determining a wellbore depth according to the present disclosure. For example, FIGS. 3A-3C can represent an operation of determining wellbore depth with the downhole tool 100 shown in FIG. 2 (with a CCL 110). In one or more initial steps as part of the illustrated operation, FIG. 3A shows the downhole tool 100 as it is moving (on downhole conveyance 45 in this example) in a downhole direction 301 from a terranean surface 12 within the wellbore 20. As shown in this example, fiber 57 is installed (and connected to the fiber interrogator 99, not shown here) between the production casing 35 and the formation (and within the cement layer 59). Casing collars 55 (including the one casing collar as shown) connect production joints 37 to form the production casing 35.

As shown in FIG. 3A, the downhole tool 100 is moving and approaches casing collar 55 with the CCL 110 operating to produce a magnetic flux 108. In the steps of the operation of the downhole tool 100 shown in FIG. 3A, the fiber optic interrogator 99 is recording a state of the fiber 57 (for example, anomalies or no anomalies) at a continuous or semi-continuous rate as the downhole tool 100 is moving in the downhole direction 301 with the CCL 110 (as well as the measurement and control sub-assembly 104) is operating to detect the casing collars 55 within the wellbore 20.

Turning to FIG. 3B, this figure shows one or more steps of the operation of the downhole tool 100 as the downhole tool 100 passes by (in downhole direction 301) one of the casing collars 55. For example, as shown, as the downhole tool 100 passes the casing collar 55 (with the CCL 110 in operation), a change in the magnetic flux 108 (in other words, a voltage spike in the CCL 110) indicates to the CCL 110 a precise location of that particular casing collar 55. Upon such an indication, the CCL 110 can output a signal to the measurement and control sub-assembly 104 indicating the precisely located casing collar 55.

Turning to FIG. 3C, this figure shows one or more steps of the operation of the downhole tool 100 subsequent to the determination of the location of the casing collar by the downhole tool 100. For example, after the CCL 110 outputs the signal to the measurement and control sub-assembly 104 indicating the precisely located casing collar 55, the measurement and control sub-assembly 104 activates the acoustic transmitter sub-assembly 118 to initiate the acoustic signal 114 from the acoustic pinger 116. One or more acoustic pulses that comprises the acoustic signal 114 can then cause a disturbance or anomaly in a portion of the fiber 57 that is located directly behind the detected casing collar 55 (in other words, the portion of the fiber 57 that is between the casing collar 55 and the formation).

Figure 4:
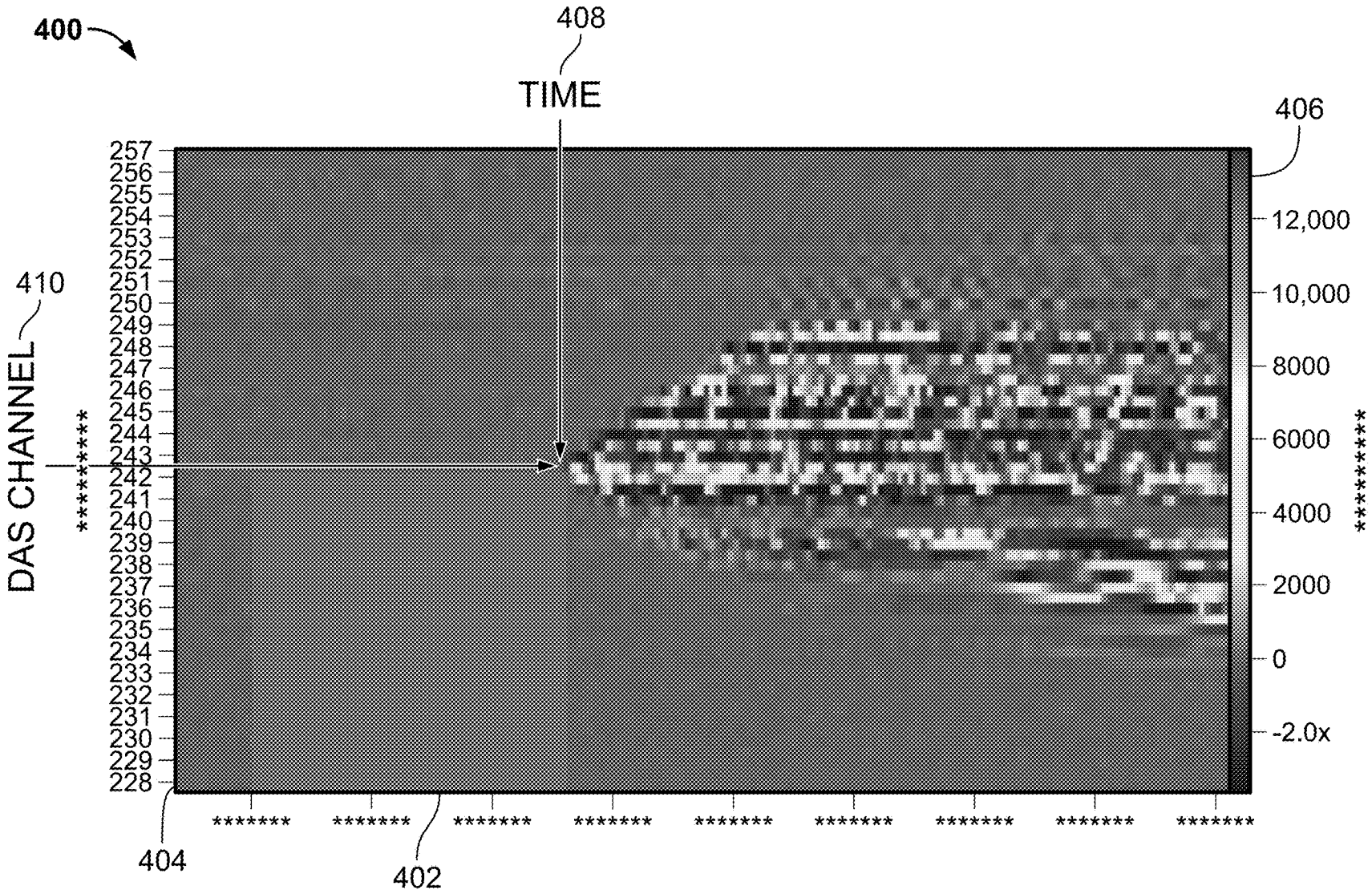
FIG. 4 is a waterfall display from a fiber optic interrogator of a disturbance on the fiber recorded by distributed acoustic sensing (DAS)

The disturbance or anomaly caused by the acoustic signal 114 is then recorded by the fiber optic interrogator 99 at the terranean surface 12 as a distributed acoustic sensing (DAS) signal. Turning briefly to FIG. 4, this figure illustrates a waterfall display 400 of a DAS signal recorded by the fiber optic interrogator 99 during operation of the downhole tool 100 in the wellbore 20 illustrating the disturbance in the optical fiber caused by the signal transmitted by the pinger or transmitter. Graph 400 includes x-axis 402, which represents time (in seconds), y-axis 404, which represents DAS channels, and 3rd- color coded out-of-plane axis 406, which represents DAS signal amplitude (in radians). As shown in graph 400, a recorded anomaly caused by a disturbance in the fiber is recorded at time 408 and DAS channel 410 (for example, CH 357).

The fiber optic interrogator 99 can (for example, continuously) record the DAS signals at a known pulse frequency rate (for example, between from 10□40 KHz) as well as backscattered reflections at the same frequency. The DAS signals are recorded and output by channels in time as shown in graph 400. Each DAS channel is a precisely sampled fiber length interval along the entire fiber 57. As the CCL 110 passes each casing collar 55 therefore, the fiber optic interrogator 99 records the disturbance caused by the acoustic signal 114 (which is initiated by the detection of the collar 55 by the CCL 110). By identifying the channel number and multiplying that number by a channel interval, a specific length of the fiber 57 from the surface 112 (or other, known location) cable associated with a casing collar 55 and subsequently registered to well depth.

Consequently, a fiber length (FL) is registered to a known casing collar 55. Movement of the downhole tool 100 in the downhole direction 301 continues over an entire interval of the wellbore 20. During such movement (which, in alternative implementations, can be in an uphole direction or both downhole and uphole directions), recording of the disturbances caused by the acoustic signals 114 initiated by the detection of each successive casing collar 55 is performed by the fiber optic interrogator 99. The resultant calculations is a direct measurement of fiber length (FL) to each casing collar depth completing the registration or calibration of fiber length (FL) to a wellbore depth (WD).

Figure 5:
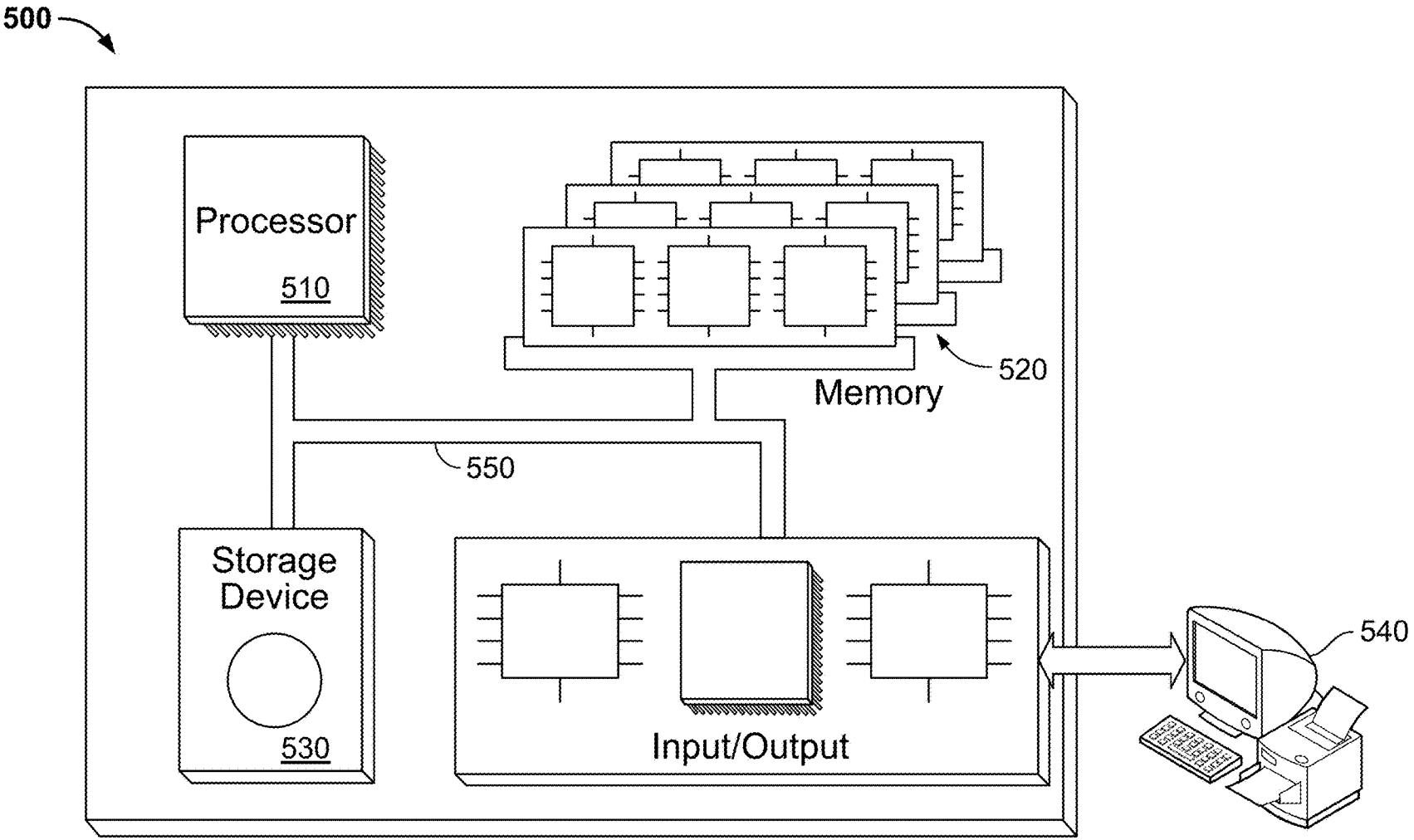
FIG. 5 is a schematic illustration of an example control system of a downhole tool for determining a wellbore depth according to the present disclosure.

FIG. 5 is a schematic illustration of an example controller 500 (or control system) for a downhole tool, such as the downhole tool 100. For example, all or parts of the controller 500 can be used for the operations described previously, for example as or as part of the control system 15, the fiber optic interrogator 99, or both. The controller 500 is intended to include various forms of digital computers, such as printed circuit boards (PCB), processors, digital circuitry, or otherwise. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 500 includes a processor 510, a memory 520, a storage device 530, and an input/output device 540. Each of the components 510, 520, 530, and 540 are interconnected using a system bus 550. The processor 510 is capable of processing instructions for execution within the controller 500. The processor may be designed using any of a number of architectures. For example, the processor 510 may be a CISC (Complex Instruction Set Computers) processor, a RISC (Reduced Instruction Set Computer) processor, or a MISC (Minimal Instruction Set Computer) processor.

In one implementation, the processor 510 is a single-threaded processor. In another implementation, the processor 510 is a multi-threaded processor. The processor 510 is capable of processing instructions stored in the memory 520 or on the storage device 530 to display graphical information for a user interface on the input/output device 540.

The memory 520 stores information within the controller 500. In one implementation, the memory 520 is a computer-readable medium. In one implementation, the memory 520 is a volatile memory unit. In another implementation, the memory 520 is a non-volatile memory unit.

The storage device 530 is capable of providing mass storage for the controller 500. In one implementation, the storage device 530 is a computer-readable medium. In various different implementations, the storage device 530 may be a floppy disk device, a hard disk device, an optical disk device, a tape device, flash memory, a solid state device (SSD), or a combination thereof The input/output device 540 provides input/output operations for the controller 500. In one implementation, the input/output device 540 includes a keyboard and/or pointing device. In another implementation, the input/output device 540 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, solid state drives (SSDs), and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) or LED (light-emitting diode) monitor for displaying information to the user and a keyboard and a pointing device such as a mouse or a trackball by which the user can provide input to the computer. Additionally, such activities can be implemented via touchscreen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole tool system, comprising:

a downhole tool, comprising:

a tool body configured to move within a wellbore between a terranean surface and a subterranean formation, a depth detection sub-assembly positioned within the tool body and configured to generate a signal based on at least one known depth location of the tool body in the wellbore, an acoustic transmitter sub-assembly positioned within the tool body and comprising an acoustic pinger configured to generate one or more acoustic pulses, and a measurement and control sub-assembly positioned within the tool body and configured to receive the signal from the depth detection sub-assembly and, based on the signal, activate the acoustic transmitter sub-assembly to initiate the one or more acoustic pulses from the acoustic pinger; and a control system that comprises a fiber optic interrogator communicably coupled to a fiber strand installed in the wellbore and configured to determine a travel time of the tool body along the fiber strand or a particular distributed acoustic sensing (DAS) channel of a plurality of DAS channels based at least in part on a detection of at least one disturbance in the fiber strand caused by the one or more acoustic pulses.

2. The downhole tool system of claim 1, wherein the depth detection sub-assembly comprises a casing collar locator (CCL) configured to detect at least one casing collar of a plurality of casing collars that are part of a casing string in the wellbore and generate the signal based on the detection of the at least one casing collar.

3. The downhole tool system of claim 2, wherein the control system is configured to associate and register fiber length or interval to a depth of a particular casing collar in the wellbore.

4. The downhole tool system of claim 3, wherein the length of the portion of the fiber strand comprises a distance of the portion of the fiber strand between a known location and a location of the detected at least one casing collar.

5. The downhole tool system of claim 1, wherein the control system is configured to determine a length of the portion of the fiber strand based at least in part on a determination of the particular distributed acoustic sensing (DAS) on which the at least one disturbance in the fiber strand caused by the one or more acoustic pulses is detected.

6. The downhole tool system of claim 5, wherein the control system is configured to determine the length of the portion of the fiber strand by multiplying the particular DAS channel by a channel interval.

7. The downhole tool system of claim 5, wherein the control system is configured to determine a length of the fiber strand by multiplying a downhole most DAS channel by a channel interval.

8. The downhole tool system of claim 7, wherein the control system is configured to determine a wellbore depth of the wellbore based at least in part on the determined length of the fiber strand.

9. The downhole tool system of claim 1, wherein the tool body comprises a top end bell configured to connect to the downhole conveyance that comprises a wireline, a slickline, a coiled tubing, or a tubular workstring.

10. The downhole tool system of claim 9, wherein the tool body is configured to move in an uphole direction or a downhole direction by a downhole conveyance.

11. The downhole tool system of claim 10, wherein the tool body comprises an untethered tool body, and the downhole conveyance comprises at least one of a fluid in the wellbore or a weight of the tool body.

12. The downhole tool system of claim 11, wherein the untethered tool body is configured to move in an uphole direction or a downhole direction based at least in part on a circulation of the fluid in the wellbore.

13. The downhole tool system of claim 1, wherein the tool body comprises a hermetically sealed housing that encloses the depth detection sub-assembly, the acoustic transmitter sub-assembly, and the measurement and control sub-assembly.

14. A method, comprising:

moving a downhole tool in a wellbore between a terranean surface and a subterranean formation, the downhole tool comprising:

a tool body, a depth detection sub-assembly positioned within the tool body, an acoustic transmitter sub-assembly positioned within the tool body and comprising an acoustic pinger, and a measurement and control sub-assembly positioned within the tool body and communicably coupled to the depth detection sub-assembly and the acoustic transmitter sub-assembly;

determining, during the movement of the downhole tool, at least one known depth location of the tool body in the wellbore;

generating a signal with the depth detection sub-assembly based on the determined at least one known depth location of the tool body in the wellbore;

activating, with the measurement and control sub-assembly and based on the generated signal, the acoustic transmitter sub-assembly to initiate one or more acoustic pulses from an acoustic pinger of the acoustic transmitter sub-assembly;

detecting, with a control system that comprises a fiber optic interrogator communicably coupled to a fiber strand installed in the wellbore, at least one disturbance in the fiber strand caused by the one or more acoustic pulses; and determining, with the control system, a travel time of the tool body along the fiber strand or a particular distributed acoustic sensing (DAS) channel of a plurality of DAS channels based at least in part on a detection of at least one disturbance in the fiber strand caused by the one or more acoustic pulses.

15. The method of claim 14, wherein the depth detection sub-assembly comprises a casing collar locator, the method further comprising:

detecting, during the movement of the downhole tool, at least one casing collar of a plurality of casing collars that are part of a casing string in the wellbore with the casing collar locator; and generating the signal with the casing collar locator based on the detection of the at least one casing collar.

16. The method of claim 15, further comprising associating and registering fiber length or interval to a depth of a particular casing collar in the wellbore.

17. The method of claim 16, wherein the length of the portion of the fiber strand comprises a distance of the portion of the fiber strand between a known location and a location of the detected at least one casing collar.

18. The method of claim 14, further comprising:

determining, with the control system, the length of the portion of the fiber strand based at least in part on a determination of the particular DAS channel on which the at least one disturbance in the fiber strand caused by the one or more acoustic pulses is detected.

19. The method of claim 18, further comprising:

determining, with the control system, the length of the portion of the fiber strand by multiplying the particular DAS channel by a channel interval.

20. The method of claim 18, further comprising:

determining, with the control system, a length of the fiber strand by multiplying a downhole most DAS channel by a channel interval.

21. The method of claim 20, further comprising:

determining, with the control system, a wellbore depth of the wellbore based at least in part on the determined length of the fiber strand.

22. The method of claim 14, further comprising moving the downhole tool in the wellbore on or with a downhole conveyance that comprises a wireline, a slickline, a coiled tubing, or a tubular workstring, and is connected to a top end bell of the tool body.

23. The method of claim 22, wherein moving the tool body comprises moving the tool body in an uphole direction or a downhole direction while coupled to the downhole conveyance.

24. The method of claim 14, wherein the tool body comprises an untethered tool body, the method further comprising moving the untethered tool body with a fluid in the wellbore.

25. The method of claim 24, wherein moving the untethered tool body with the fluid in the wellbore comprises:

moving the untethered tool body in an uphole direction or a downhole direction based at least in part on a circulation of the fluid in the wellbore.

26. The method of claim 14, further comprising hermetically sealing the tool body against one or more wellbore fluids in the wellbore.

* * * * *